US008509665B2

(12) United States Patent
Barton et al.

(10) Patent No.: US 8,509,665 B2
(45) Date of Patent: Aug. 13, 2013

(54) REDISTRIBUTING RELEASE AGENT USING A SMOOTHING ROLL IN AN IMAGE FORMING SYSTEM

(75) Inventors: Augusto E. Barton, Webster, NY (US); James Padula, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 313 days.

(21) Appl. No.: 12/971,625

(22) Filed: Dec. 17, 2010

(65) Prior Publication Data

US 2012/0155929 A1 Jun. 21, 2012

(51) Int. Cl.
*G03G 15/20* (2006.01)

(52) U.S. Cl.
USPC ..... 399/325; 399/324; 399/326; 399/327

(58) Field of Classification Search
USPC ..... 399/324, 325, 326, 327, 340
See application file for complete search history.

(56) References Cited

U.S. PATENT DOCUMENTS

| | | | | |
|---|---|---|---|---|
| 4,045,165 | A * | 8/1977 | Nakajima et al. | 399/328 |
| 6,078,779 | A * | 6/2000 | Hachisuga | 399/325 |
| 6,449,456 | B1 * | 9/2002 | Cahill et al. | 399/325 |
| 6,778,804 | B2 * | 8/2004 | Yoshinaga et al. | 399/325 |
| 6,925,280 | B2 * | 8/2005 | Yamada | 399/325 |
| 7,266,336 | B2 * | 9/2007 | Ueno et al. | 399/329 |
| 7,979,014 | B2 * | 7/2011 | Achten et al. | 399/327 |
| 2002/0048471 | A1 * | 4/2002 | Ishizuka | 399/325 |
| 2003/0007813 | A1 * | 1/2003 | Yasui et al. | 399/324 |
| 2003/0215271 | A1 * | 11/2003 | Yoshinaga et al. | 399/325 |

FOREIGN PATENT DOCUMENTS

| | | | |
|---|---|---|---|
| JP | 2004069856 | A * | 3/2004 |
| WO | WO 9706470 | A1 * | 2/1997 |

OTHER PUBLICATIONS

Augusto E. Barton; "Redistributing Release Agent Using a Flexible Blade in an Image Forming System"; U.S. Appl. No. 12/914,365, filed Oct. 28, 2010.

* cited by examiner

*Primary Examiner* — David Gray
*Assistant Examiner* — Francis Gray
(74) *Attorney, Agent, or Firm* — Ronald E. Prass, Jr.; Prass LLP

(57) ABSTRACT

According to various illustrative embodiments, an apparatus for redistributing release agent on a fuser surface of an image forming device is provided. The apparatus has a fuser surface for contacting a sheet of media having an image formed thereon by the image forming device, the fuser surface moving in a traveling direction; and a smoothing roll for redistributing the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution. The smoothing roll is adapted to redistribute the release agent such that the second distribution is more uniform across the fuser surface than the first post-fusing distribution.

29 Claims, 3 Drawing Sheets

REDISTRIBUTING RELEASE AGENT USING A SMOOTHING ROLL IN AN IMAGE FORMING SYSTEM

BACKGROUND

The present disclosure relates generally to fuser release fluid control in imaging systems. More particularly, the present disclosure describes an apparatus, method, and system useful for reducing oil ghosting in imaging systems.

The fuser release fluid distribution on the surface of a roll or belt in an imaging system can have detrimental effects on image quality if not properly controlled. For example, if release fluid (for example, oil) is not evenly distributed on the portion of a surface (for example, a fuser roll or belt) that comes in contact with the media, oil ghosting can result in the form of a gloss band on the media. Oil ghosting can result from excess oil on, for example, the inter document zone (IDZ) of the fuser surface that exists between sheets of media, or on the outside paper path (OPP) area of the fuser surface when switching to wider media.

SUMMARY

An apparatus for redistributing release agent on a fuser surface of an image forming device is provided. The apparatus has a fuser surface for contacting a sheet of media having an image formed thereon by the image forming device, the fuser surface moving in a traveling direction; and a smoothing roll for redistributing the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution wherein the smoothing roll is adapted to redistribute the release agent such that the second distribution is more uniform across the fuser surface than the first post-fusing distribution.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

Figure 1:
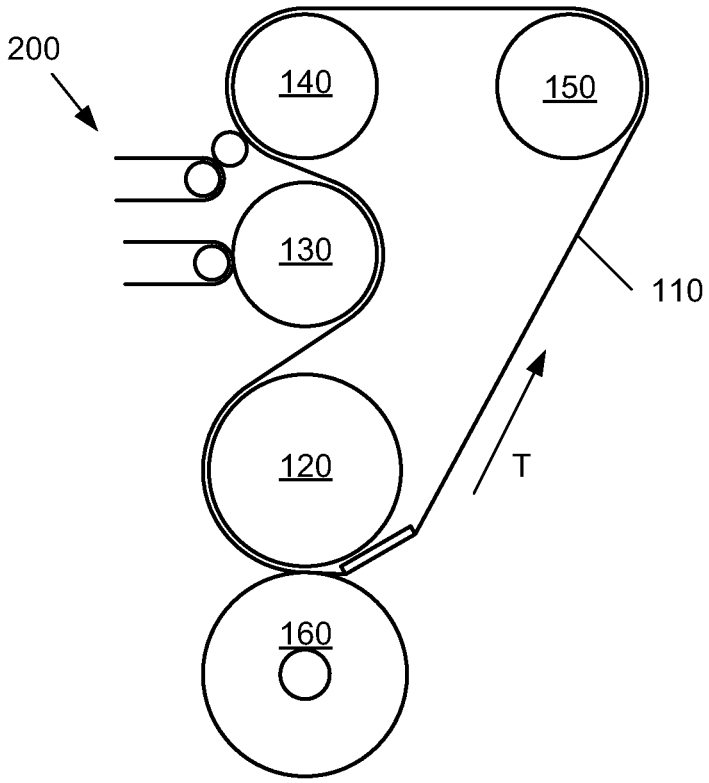
FIG. 1 schematically illustrates a particular example of various illustrative embodiments of an apparatus in accordance with the present disclosure.

It is to be noted, however, that the appended drawings illustrate only typical embodiments of the disclosed subject matter and are, therefore, not to be considered limiting of the scope of the disclosed subject matter, as the disclosed subject matter may admit to other equally effective embodiments.

DETAILED DESCRIPTION

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

The disclosed embodiments may include an apparatus for redistributing release agent on a fuser surface of an image forming device. The apparatus has a fuser surface for contacting a sheet of media having an image formed thereon by the image forming device, the fuser surface moving in a traveling direction; and a smoothing roll for redistributing the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution. The smoothing roll is adapted to redistribute the release agent such that the second distribution is more uniform across the fuser surface than the first post-fusing distribution.

The disclosed embodiments may further include an image forming device. The image forming devices has a media transport path for transporting a sheet of media having an image formed thereon; a fuser surface for contacting the sheet of media, the fuser surface moving in a traveling direction; and a smoothing roll for redistributing release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution. The smoothing roll is adapted to redistribute the release agent such that the second distribution is more uniform across the fuser surface than the first post-fusing distribution.

The disclosed embodiments may further include a method of redistributing release agent on a fuser surface of an image forming device. The method includes providing a fuser surface for contacting a sheet of media having an image formed thereon by the image forming device; moving the fuser surface in a traveling direction; and contacting a release agent present on the fuser surface with a smoothing roll such that the smoothing roll redistributes the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution. The smoothing roll redistributes the release agent such that the second distribution is more uniform across the fuser surface than the first post-fusing distribution.

Oil ghosting can show up as a gloss band which is caused by excess release agent (for example, oil) left on a fusing surface. This can happen in the inter document zone (the area between sheets of media) and/or outside the paper path. In the inter document zone (IDZ) there is no paper to transfer the release agent to, which results in the fusing surface being left with excess release agent. Also, long runs of narrow media can result in excess release agent collecting outside the paper path ("OPP") causing an undesirable gloss differential when switching to wider media. For ease of description, the term "oil" will be used to refer to release agents of all types.

Exemplary embodiments of the disclosure propose the use of a smoothing roll to smooth the oil layer so that oil ghosting will be mitigated to a point at which it is not detectable. The smoothing roll may also remove part or all of the excess oil.

Applicants' tests show that when the smoothing roll is pressed against the fusing surface with an adequate force, oil ghosting can be reduced or eliminated.

Testing was performed to determine the relative importance of nip pressure and nip width. It was confirmed that nip pressure is important to reduce the appearance of IDZ oil ghosting and nip width is not as important. An example of a sufficient pressure to reduce IDZ oil ghosting to an unnoticed level is about 30 psi. Because testing revealed that nip width is not critical, small diameter smoothing rolls can be used. An example of an appropriate smoothing roll is a diameter of about 20 mm having about 1 mm to 3 mm of silicone rubber and a thin Viton® graft coating of about 20 μm. However, other materials can be used as long as the material can withstand the high temperatures that exist in an image fusing system, and is compatible with the release agent. In the particular case where the release agent is silicone oil and the fusing temperatures are above 180 degrees Celsius, a material such as Viton® will be suitable.

As used herein, the term "image forming device" encompasses any apparatus, such as a digital copier, bookmaking machine, multifunction machine, and the like, that performs a print outputting function for any purpose. The image forming device can be used to produce prints from various types of media, such as coated or uncoated (plain) paper sheets, at high speeds. The media can have various sizes and weights.

FIG. 1 shows an example of a partial image forming device in accordance with embodiments of the disclosure. In the example shown in FIG. 1, a fuser surface 110 is in the form of an endless belt that is guided by rolls 120, 130, 140, 150, and moves in a traveling direction T. Although fuser surface 110 is a belt in this example, the fuser surface can be a roll or other rotating member in other embodiments. Although embodiments of the disclosure will work with both fuser rolls and fuser belts (and other rotating members), it may be particularly beneficial when used with a fuser belt. Fuser rolls usually use a high pressure nip that can help in spreading the oil uniformly across the surface of the roll. Because fuser belts may not use a high pressure nip like that used by fuser rolls, embodiments of the disclosure may result in a bigger improvement in image quality in devices using a fuser belt than in devices using a fuser roll. In exemplary embodiments, a piece of media containing an image is passed between fuser surface 110 and a roll 160 to fuse the image to the piece of media.

As discussed above, a release agent is applied to fuser surface 110 during the operation of the image forming device. The release agent can be, for example, a silicone oil. The release agent builds up unevenly on fuser surface 110, especially in the IDZ and OPP, after images are fused to the media. To improve the image quality, an apparatus for redistributing release agent 200 is provided to redistribute the release agent more uniformly across the face of fuser surface 110.

Figure 2:
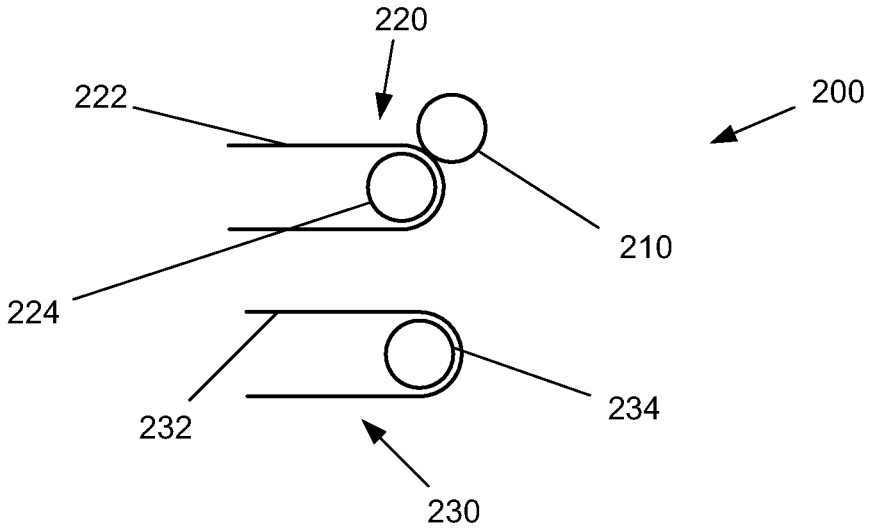
FIG. 2 schematically illustrates a particular example of various illustrative embodiments of a smoothing roll assembly in accordance with the present disclosure.

Apparatus 200 is shown in FIG. 2 as having, in this example, a smoothing roll 210 which is pressed into contact with fuser surface 110 such that the release agent on fuser surface 110 is spread substantially evenly across the width of fuser surface 110.

In embodiments, the fuser surface has an overall width in a transverse direction that is perpendicular to the travelling direction. Oil may be applied to a portion of the fuser surface that is less than the overall width of the fuser surface. As a result, smoothing roll 210 may have a length that is less than the overall width of the fuser surface or it may have a length that is equal, or greater than, the overall width of the fuser surface. For example, smoothing roll 210 may have a length substantially equal to the width of the oiled portion of the fuser surface. Embodiments may include a smoothing roll or rolls that contact the fuser surface only at areas of the fuser surface that are not used to fuse images to media, such as, for example, areas at the edges of the fuser surface which are outside of the image area.

Exemplary embodiments of the disclosure position smoothing roll 210 such that it presses against fuser surface 110 while fuser surface 110 is supported on the hard surface of an internal roll (for example roll 140). However, other embodiments can position smoothing roll 210 at a location where fuser surface 110 is not supported on the hard surface of an internal roll. The release agent removed by smoothing roll 210 can be removed by a roll cleaner. The release agent removed by smoothing roll 210 may, in some embodiments, be returned to the oil system. The oil returned can, for example, go to the ram, to the oil bottle or to a separate oil waste bottle.

In the embodiment shown in FIGS. 1 and 2, a roll cleaner 220 is provided for cleaning smoothing roll 210. Roll cleaner 220 includes a cleaner belt 222 that is supported by a support roll 224. Cleaner belt 222 contacts smoothing roll 210 and removes excess release agent and/or contaminants that collect on smoothing roll 210. The embodiment shown in FIGS. 1 and 2 also includes a roll cleaner 230 that cleans, in this example, a heating roll. Roll cleaner 230, or an additional roll cleaner, can be used to clean another roll that contacts the fuser surface. Similarly to roll cleaner 220, roll cleaner 230 includes a cleaner belt 232 that is supported by a support roll 234.

As mentioned above, embodiments of the disclosure can be used in devices having fuser rolls as well as those (such as the embodiment shown) using a fuser belt. However, because a fuser belt typically has a greater perimeter than a fuser roll, a fuser belt provides more locations at which apparatus 200 can be beneficially located.

In embodiments, smoothing roll 210 (and in some embodiments, apparatus 200) is movable such that a controller can direct smoothing roll 210 to move between positions in which smoothing roll 210 is engaged with or disengaged with fuser surface 110. Types of movement control devices for moving smoothing roll 210 can include, for example, a titling mechanism and a translational movement mechanism. The controller can control movement of the smoothing roll for many purposes. For example, the movement of the smoothing roll can be timed so that the smoothing roll engages the fuser surface at a position that corresponds to a position just before the trailing edge of a sheet of media. This would reduce the amount of, or eliminate, oil on the sheet of media where the media is to be bound to other sheets of media. This reduction, or elimination, of oil can help produce a stronger binding.

The viscosity of the oil usually decreases with increased temperature. This property can be used to produce better results depending on whether even spreading of the oil is desired or removal of the oil is desired. If even spreading of the oil is desired, the oil can spread by the smoothing roll at a point just after the oil has been heated (to reduce viscosity). The oil can be heated by heating the fuser surface through one of the rolls, for example, or some other heating device. If removal of the oil is desired, a higher viscosity is desirable. To obtain a higher viscosity, the oil can be removed by the smoothing roll at a point on the fuser surface that is allowed to cool (or is not heated).

Figure 3:
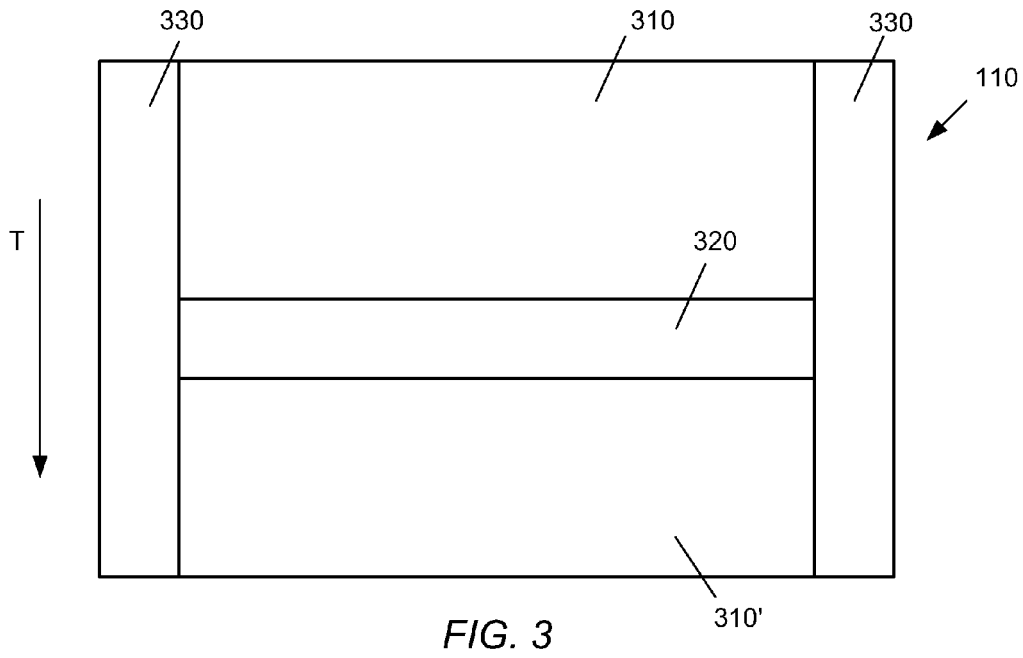
FIG. 3 schematically illustrates an example of a fuser surface having release agent on an inter document zone and on an outside paper path area.
Figure 4:
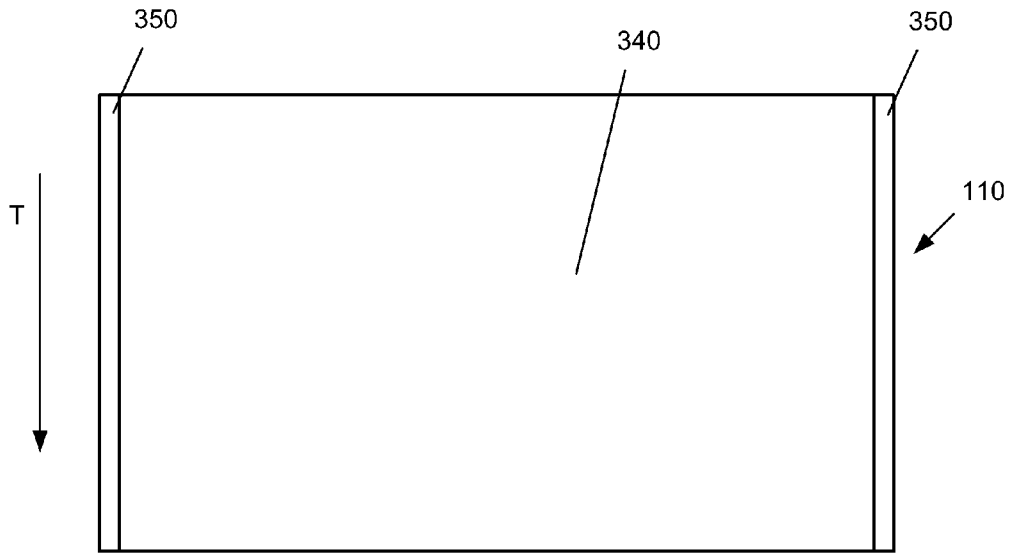
FIG. 4 schematically illustrates an example of a fuser surface after having the release agent smoothed by an embodiment of the disclosure.

FIGS. 3 and 4 show examples of a fuser surface 110 viewed from a direction perpendicular to the view shown in FIG. 1. Travel direction T is shown in a downward direction in FIGS. 3 and 4, but could also be in an upward direction. FIG. 3 shows an example of a fuser surface 110 having oil deposited in an IDZ 320. FIG. 3 also shows oil deposited in an OPP area 330 on each edge of fuser surface 110. The areas designated as 310 and 310' each represent an area at which a piece of media contacted fuser surface 110. After the fusing process, the distribution of oil in areas 310, 310' is normally thinner than in areas 320 and 330. In some cases, little or no oil exists in areas 310, 310'. If two successive pieces of media are closer together, IDZ 320 will be smaller (shorter top to bottom in FIG. 3). If the sheet of media is wider, OPP areas 330 will be smaller (narrower side to side in FIG. 3). Also, even though the two areas 330 are shown having the same width, if the media is not centered width-wise on fuser surface 110, the two areas 330 will be different widths.

FIG. 4 shows an example of the oil distribution on fuser surface 110 after having passed by smoothing roll 210. Area 340 has a uniform distribution of oil or, in some cases, no oil at all. The width of area 340 corresponds to the width of smoothing roll 210. In this example, two small areas 350 are shown outside of area 340 because, in this example, smoothing roll 210 has a smaller width than fuser surface 110. If smoothing roll 210 has a width that is equal to, or wider than, the width of fuser surface 110, then no areas 350 will exist.

Figure 5:
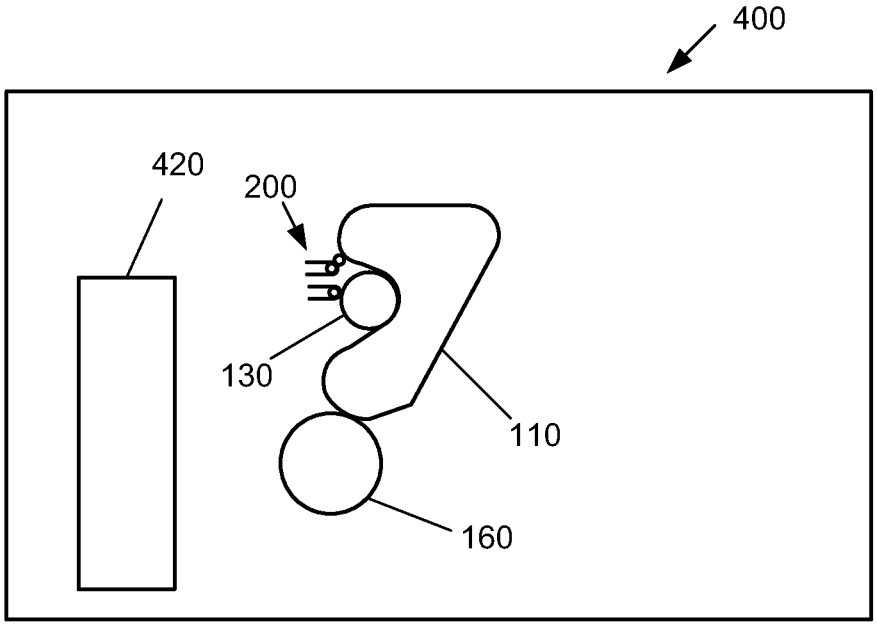
FIG. 5 schematically illustrates a particular example of various illustrative embodiments of an image forming system in accordance with the present disclosure.

FIG. 5 shows an example of an image forming device 400 in accordance with embodiments of the disclosure. Image forming device 400 includes a media storage device 420 for storing media that will have images formed thereon by image forming device 400. A paper path (not shown) moves paper or other media from media storage device 420 to various other sections in image forming device 400 including fuser surface 110. Fuser surface 110 is shown schematically along with rolls 130, 160 and apparatus for redistributing release agent 200. The functions of fuser surface 110, roll 130, roll 160, and apparatus for redistributing release agent 200 are similar to those discussed above.

Figure 6:
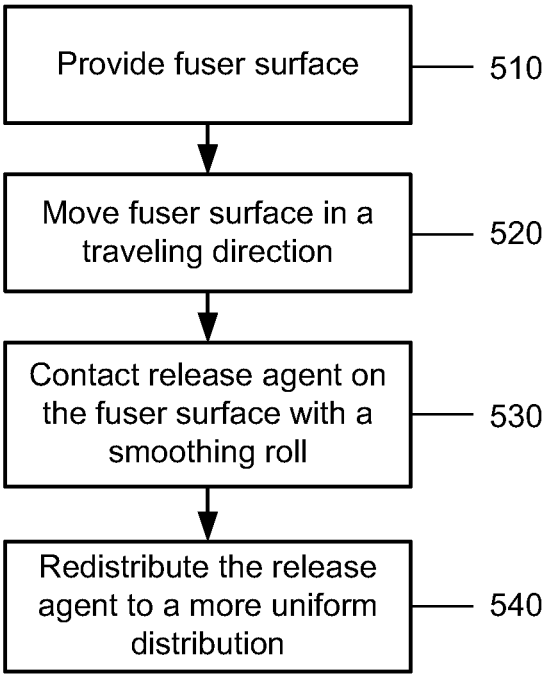
FIG. 6 shows a particular example of a method in accordance with the present disclosure.

FIG. 6 shows an example of a method in accordance with embodiments of the disclosure. A fuser surface, such as fuser surface 110, is provided in 510. The fuser surface is moved in a traveling direction, such as direction T, in 520. A smoothing roll, such as smoothing roll 210, is brought into contact with a release agent that exists on the fuser surface in 530. In 540 the release agent on the fuser surface is redistributed by the smoothing roll in order to form a more uniform layer of release agent on the fuser surface.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for redistributing release agent on a fuser surface of an image forming device, the apparatus comprising:

a fuser surface for contacting a sheet of media having an image formed thereon by the image forming device, the fuser surface moving in a traveling direction;

a smoothing roll for redistributing the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution; and a first roll cleaner that contacts the smoothing roll to remove contaminants and/or release agent from the smoothing roll, wherein the smoothing roll is adapted to redistribute the release agent such that the second distribution is more uniform across the fuser surface than the first post-fusing distribution.

2. The apparatus of claim 1, wherein the fuser surface is a surface of a fuser belt.

3. The apparatus of claim 2, wherein the fuser surface has an overall width in a transverse direction that is perpendicular to the travelling direction, and an oiled width that is a portion of the overall width and to which release agent is applied, and the contact area extends substantially the entire oiled width of the fuser surface.

4. The apparatus of claim 3, wherein the contact area includes an inter document zone.

5. The apparatus of claim 3, wherein the contact area includes an outside paper path region.

6. The apparatus of claim 3, wherein the contact area extends in the transverse direction.

7. The apparatus of claim 3, wherein the contact area extends in a direction that is non-parallel to the transverse direction.

8. The apparatus of claim 3, further comprising a support member supporting the fuser surface at the contact area.

9. The apparatus of claim 8, wherein the support member is a roll.

10. The apparatus of claim 2, wherein the fuser surface has an overall width in a transverse direction that is perpendicular to the travelling direction, and an oiled width that is a portion of the overall width and to which release agent is applied, and the contact area extends substantially the entire overall width of the fuser surface.

11. The apparatus of claim 1, wherein the fuser surface is a surface of a fuser belt, and the apparatus further comprises an external roll that supports the fuser surface; and a second roll cleaner that contacts the external roll, the second roll cleaner contacts the external roll to remove contaminants and/or release agent from the external roll.

12. An image forming device, comprising:

a media transport path for transporting a sheet of media having an image formed thereon;

a fuser surface for contacting the sheet of media, the fuser surface moving in a traveling direction;

a smoothing roll for redistributing release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution; and a first roll cleaner that contacts the smoothing roll to remove contaminants and/or release agent from the smoothing roll, wherein the smoothing roll is adapted to redistribute the release agent such that the second distribution is more uniform across the fuser surface than the first post-fusing distribution.

13. The device of claim 12, wherein the fuser surface is a surface of a fuser belt.

14. The device of claim 13, wherein the fuser surface has an overall width in a transverse direction that is perpendicular to the traveling direction, and an oiled width that is a portion of the overall width and to which release agent is applied, and the contact area extends substantially the entire oiled width of the fuser surface.

15. The device of claim 14, wherein the contact area includes an inter document zone.

16. The device of claim 14, wherein the contact area includes an outside paper path region.

17. The device of claim 14, wherein the contact area extends in the transverse direction.

18. The device of claim 14, wherein the contact area extends in a direction that is non-parallel to the transverse direction.

19. The device of claim 14, further comprising a support member supporting the fuser surface at the contact area.

20. The device of claim 19, wherein the support member is a roll.

21. The device of claim 13, wherein the fuser surface has an overall width in a transverse direction that is perpendicular to the traveling direction, and an oiled width that is a portion of the overall width and to which release agent is applied, and the contact area extends substantially the entire overall width of the fuser surface.

22. The device of claim 12, wherein the fuser surface is a surface of a fuser belt, and the apparatus further comprises an external roll that supports the fuser surface; and a second roll cleaner that contacts the external roll, the second roll cleaner contacts the external roll to remove contaminants and/or release agent from the external roll.

23. A method of redistributing release agent on a fuser surface of an image forming device, the method comprising:

providing a fuser surface for contacting a sheet of media having an image formed thereon by the image forming device;

moving the fuser surface in a traveling direction;

contacting a release agent present on the fuser surface with a smoothing roll such that the smoothing roll redistributes the release agent on the fuser surface from a first post-fusing distribution to a second distribution, the smoothing roll contacting the release agent on the fuser surface at a contact area and pressing the release agent against the fuser surface to redistribute the release agent from the first post-fusing distribution to the second distribution; and removing contaminants and/or release agent from the smoothing roll with a first roll cleaner that contacts the smoothing roll, wherein the smoothing roll redistributes the release agent such that the second distribution is more uniform across the fuser surface than the first post-fusing distribution.

24. The method of claim 23, wherein the fuser surface is provided on a surface of a fuser belt.

25. The method of claim 23, wherein the fuser surface has an overall width in a transverse direction that is perpendicular to the traveling direction, and an oiled width that is a portion of the overall width and to which release agent is applied, and the contact area extends substantially the entire oiled width of the fuser surface.

26. The method of claim 23, wherein the fuser surface has an overall width in a transverse direction that is perpendicular to the traveling direction, and an oiled width that is a portion of the overall width and to which release agent is applied, and the contact area extends substantially the entire overall width of the fuser surface.

27. The method of claim 23, wherein the contact area is located at a position on the fuser surface that is warmer than other positions on the fuser surface, such that the second distribution is a uniform layer of release agent.

28. The method of claim 23, wherein the contact area is located at a position on the fuser surface that is cooler than other positions on the fuser surface, such that the second distribution is substantially no release agent.

29. The method of claim 23, wherein the fuser surface is provided on a surface of a fuser belt, and the method further comprises removing contaminants and/or release agent from an external roll that supports the fuser surface with a second roll cleaner that contacts the external roll.

* * * * *